United States Patent [19]

Krakow

[11] 4,140,064

[45] Feb. 20, 1979

[54] DUAL POSITION TABLE TOP SUPPORT

[76] Inventor: Kalman I. Krakow, 780 Querbes Ave., Apt. 101, Outremont, Quebec, Canada

[21] Appl. No.: 714,585

[22] Filed: Aug. 16, 1976

[30] Foreign Application Priority Data

Aug. 21, 1975 [CA] Canada ..... 233910

[51] Int. Cl.[2] ..... A47B 37/00

[52] U.S. Cl. ..... 108/42; 312/242

[58] Field of Search ..... 108/42, 48; 312/242; 61/39, 39.1, 41 R; 248/354 R

[56] References Cited

U.S. PATENT DOCUMENTS

| | | | |
|---|---|---|---|
| 523,679 | 7/1894 | McLenathan | 108/42 |
| 834,095 | 10/1906 | Whitcomb | 108/42 |
| 1,312,137 | 8/1919 | Schloss | 108/131 |
| 1,521,902 | 1/1925 | Mott | 108/42 |
| 3,698,329 | 10/1972 | Diamond et al. | 108/42 |

*Primary Examiner*—Roy D. Frazier
*Assistant Examiner*—William E. Lyddane
*Attorney, Agent, or Firm*—Bernard Malina

[57] ABSTRACT

This invention, entitled "dual position table top support" permits a table top to be supported in a horizontal working position or in a vertical out-of-the way storing position. The support is such that it is to be installed in an area bounded by three adjacent walls without having to fasten it physically, i.e. by means of screws, nails, rivets, adhesive, to any wall. It is intended for use in locations where a free-standing support or a support physically fastened to a wall is impractical. It is particularly suited for installation over a bathtub to provide a utility table suitable for hobbyists such as amature photographers who use their bathroom as a temporary darkroom.

12 Claims, 24 Drawing Figures

DUAL POSITION TABLE TOP SUPPORT

This invention, entitled "dual position table-top support" relates to an apparatus for supporting a table top in either a working or a storage mode.

In many apartments space for a permanent table for utility use by hobbyists and others is unavailable, necessitating the use of folding tables which can be stored when not in use. Folding tables may be either portable or supported by hinged wall-mounted brackets. Portable tables may be inconvenient because of storage requirements. Hinged wall-mounted supports require physically fastening them to the wall by means which are often prohibited by leases.

The dual position table-top support, consisting of two side members and one cross member which wedges the two side members against walls, does not require any physical fastenings, such as screws, rivets, nails, adhesives, etc. and has provision for storing the table top when not in use. This dual position table-top support is especially well suited for installation over a bathtub, facilitating the use of the bathroom for a second purpose, for example, as a temporary photographic darkroom.

In the drawings which illustrate the embodiments of the invention:

FIGS. 1, 2, and 3 are orthographic views of the top, side, and back, respectively, of a left-side member.

FIGS. 4 and 5 are orthographic views of the back and side, respectively, of a right-side member.

FIGS. 6 and 7 are orthographic views of the front and side, respectively, of the compression member, FIG. 8 is a front view showing the installation of the table-top support with a table-top in a working position, FIG. 9 is a cross-sectional view along the line AA of FIG. 8, FIG. 10 is a front view showing the installation of the table-top support with a table-top in a storage position, FIG. 11 is a cross-sectional view along the line BB of FIG. 10.

Figure 22:
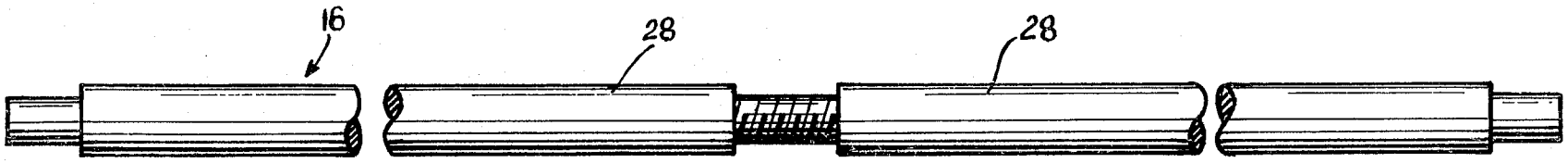
Figure 23:
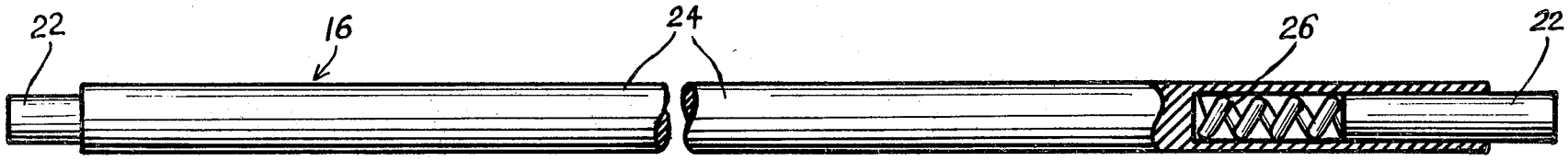
Figure 24:
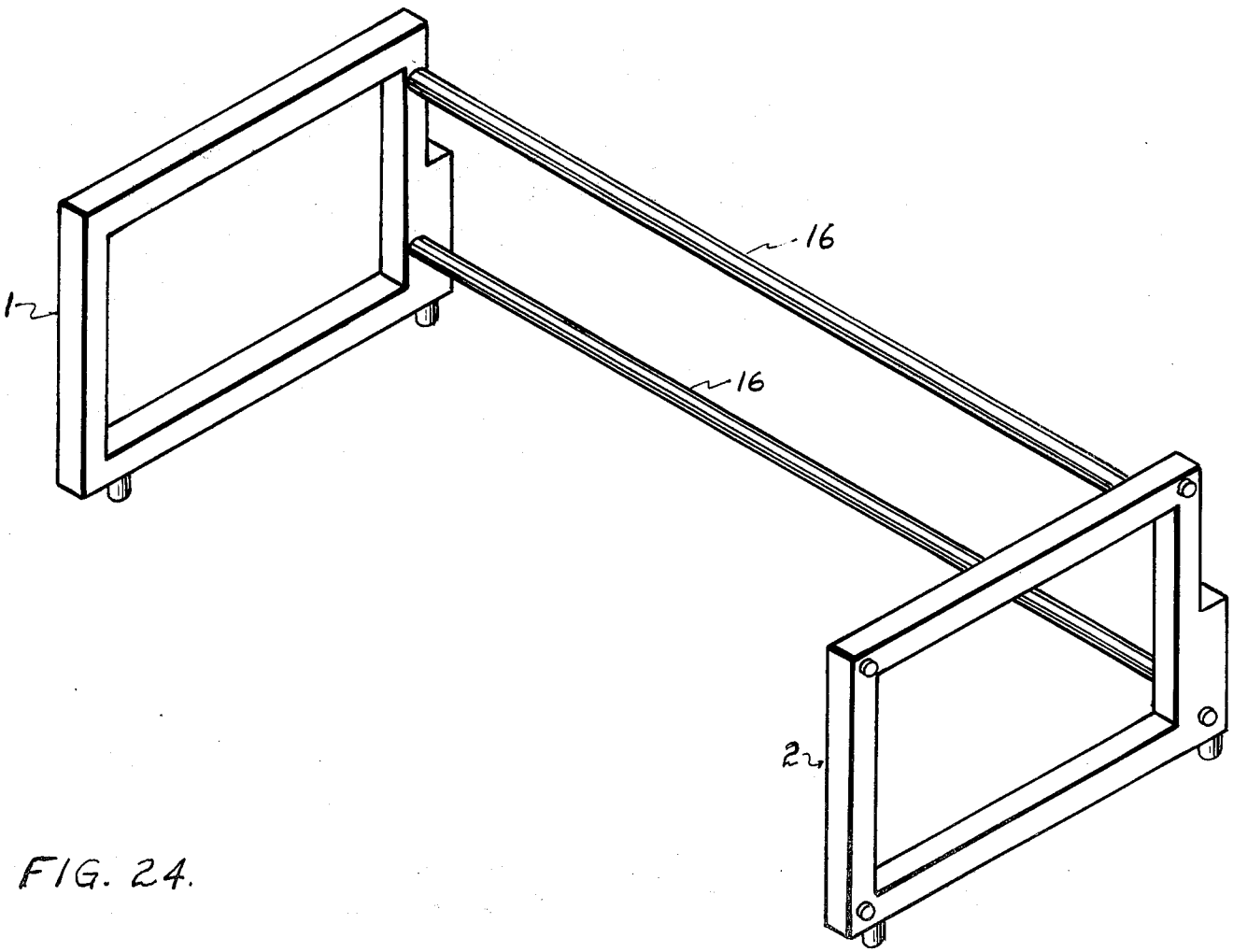

FIG. 22 is a view of a compression member having a screw device for adjustment of length and compressive force, FIG. 23 is a view of a compression member having a spring loaded device for adjustment of length and compressive force, and FIG. 24 is a pictorial view of a dual position table top support assembly showing a left side member, a right side member and two compression members having screw or spring load devices.

Figure 1:
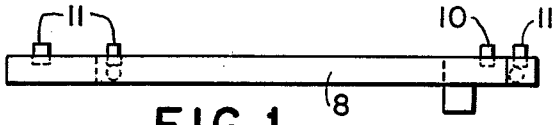
Figure 2:
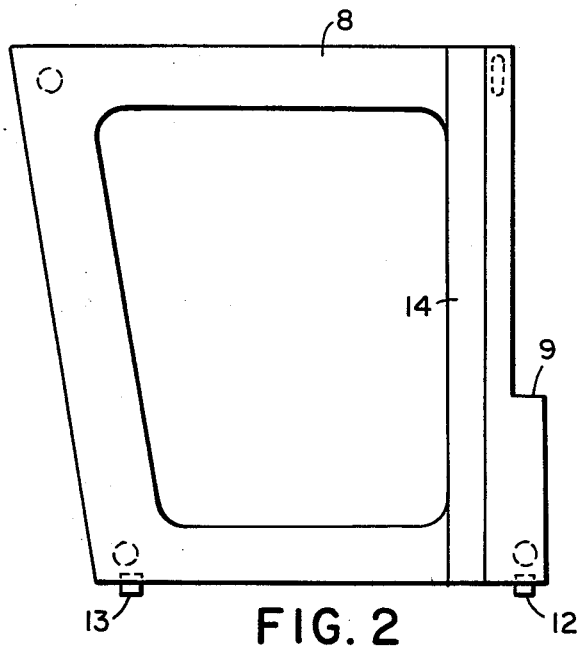
Figure 3:
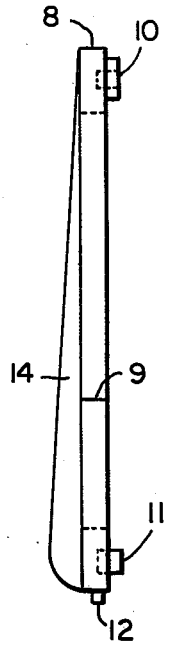
Figure 4:
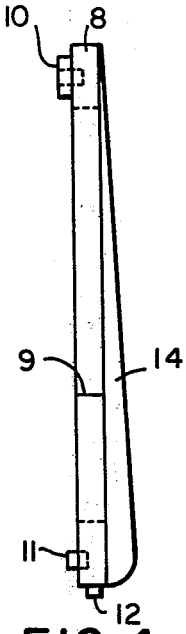
Figure 5:
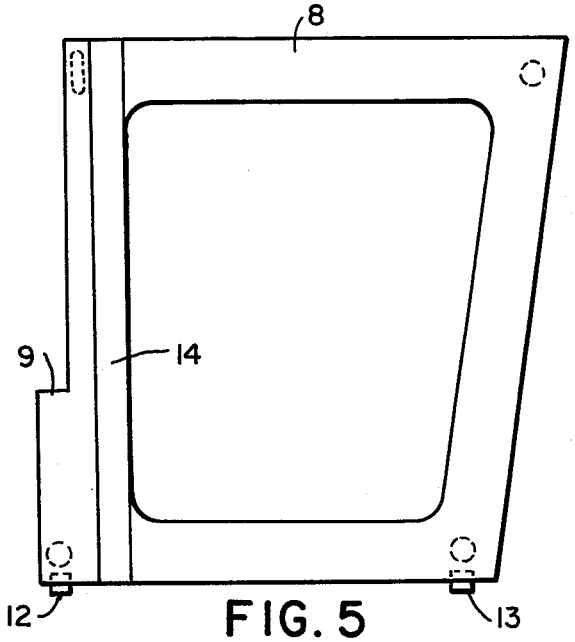
Figure 6:
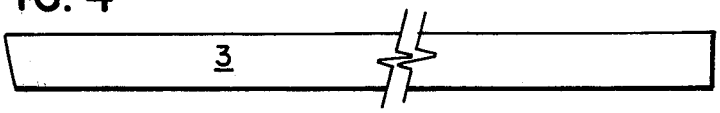
Figure 7:
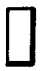
Figure 9:
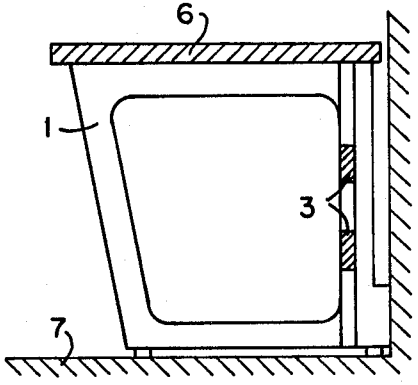
Figure 11:
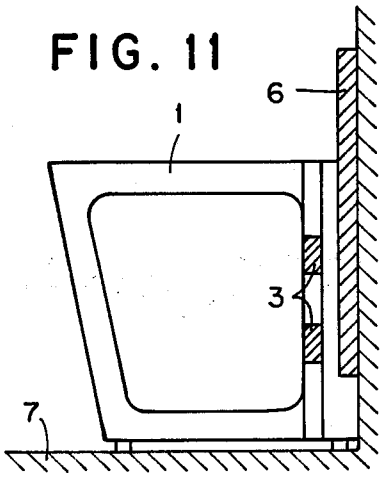
Figure 8:
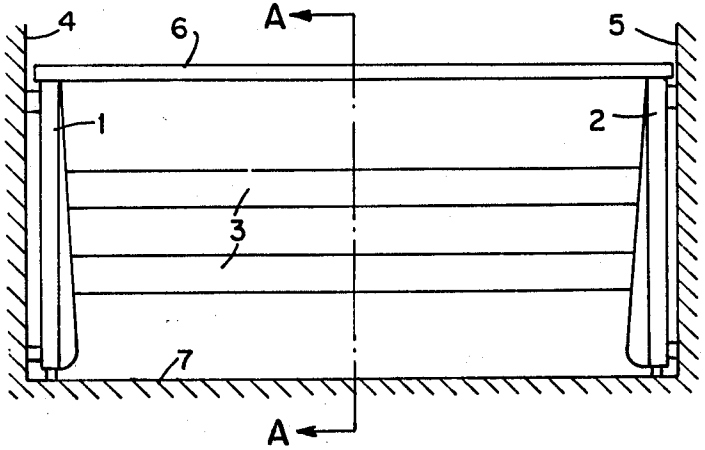
Figure 10:
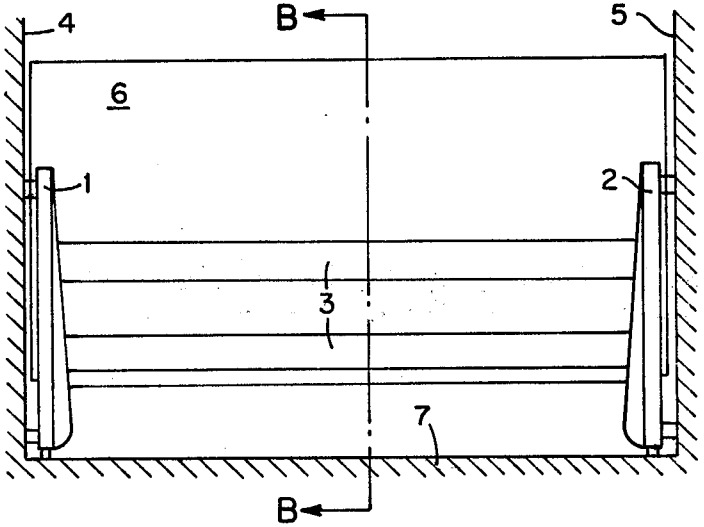

The table-top support illustrated comprises of a left side member 1 as shown in FIGS. 1, 2, and 3, a right side member 2 as shown in FIGS. 4 and 5, and at least one compression member 3 as shown in FIGS. 6 and 7. The table-top support is to be installed in an area bound by three adjacent walls, two of which face each other and are the side walls. The left side member 1 is placed against the left side wall 4 and the right side member 2 is placed against the right side wall 5 and the compression members 3 are placed in position between the side members and forced downward so that the side members are in turn forced against the side walls as shown in FIGS. 8, 9, 10 and 11. The side members rest on a base 7 which may be a floor or the top sill of a bathtub. A table-top 6 may be placed on and supported by the side members in a horizontal working position or in a vertical storage position by simply lifting the top and placing it in the desired position.

Each side member has the following features:

- a horizontal surface 8 for supporting a table-top in a working position,
- a surface 9 for supporting a table-top on its edge in a storage position,
- one fixed side wall contactor 10,
- two or three adjustable or fixed side wall contactors 11,
- one fixed bottom contactor 12,
- one adjustable or fixed bottom contactor 13,
- a central cut-out, so that members may be placed over a bathtub allowing the bathtub faucets and handles to fall within the cut-out area so that their operation is not impeded.

Supports designed for installation in locations where the walls are not perfectly or reasonably perpendicular and the base, floor or bathtub sill, is not perfectly or reasonably level, shall have adjustable side wall contactors 11 and an adjustable bottom contactor 13. The adjustment of the contactors may be accomplished by means of a screw type device or by a wedging device which moves the contactors relative to the side members. Supports designed for installation in locations where the walls are reasonably perpendicular and the base is reasonably level may have the side wall and bottom contactors as an integral part of the side members, i.e. fixed. In either case, the side and the bottom contactors shall provide a space between the side members and the side walls and base so that when the support is placed over a bathtub and a shower is used with the table in the storage position, the flow of water down the walls into the bathtub is not adversely affected. Further, the limited number of the contactors shall facilitate installation in locations with uneven walls or base, floor or bathtub sill.

The compression member support surfaces 14 are located so that the line of action of the force of the compression member 3 lies in the interior of the figure formed by lines joining the side wall contactors. The compression member support surfaces are sloped so that when the one-piece compression member 3, as shown in FIGS. 6 and 7, having correspondingly sloped ends, is placed in position and forced downward, the side members are forced outward against the side walls. The length of the compression member support surfaces 14 is such that the position of the compression member may be adjusted, by placing the compression member at the appropriate height, for force against the side members as well as for small variations in the distance between side walls 4 and 5 without having to change, increase or decrease, the length of the compression member.

Alternately, the compression member support surfaces may be vertical and one or more spring loaded compression members 16 as shown in FIG. 23, which consist of either one or two end pieces 22 which slide inside a hollow central section 24 containing one or two compression springs 26, may be used instead of the one piece compression member. As a second alternative, the compression member support surfaces may be vertical and one or more threaded compression members 16 as shown in FIG. 22, each made of two or more pieces 28 which screw into one another to permit adjustment of length and compressive force, may be used instead of the one piece compression member. One or more pieces of spring loaded or threaded compression members may be permanently attached to the side members.

Figure 12:
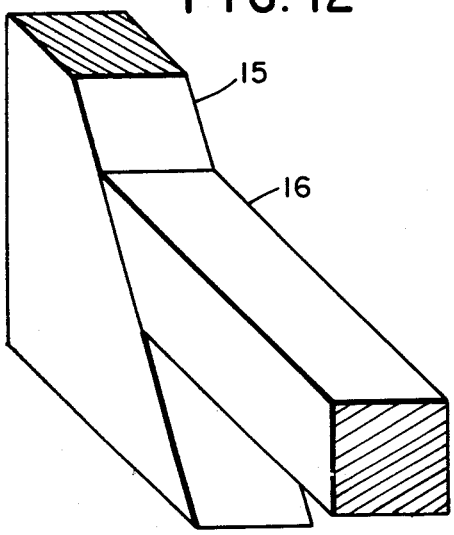
FIGS. 12 to 16 are pictorial views of a junction between a side member and a one-piece compression member having two plane members, a grooved side member and a plane compression member, a grooved side member and a tongued compression member, a plane side member and a grooved compression member, and, a tongued side member and a grooved compression member, respectively.
Figure 15:
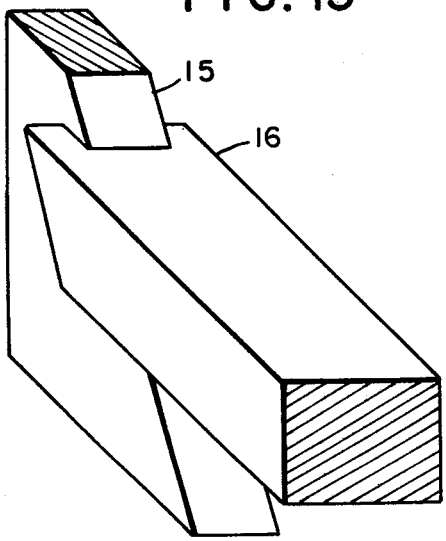
Figure 13:
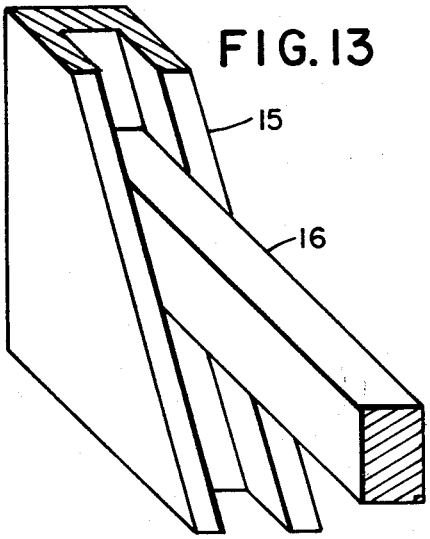
Figure 16:
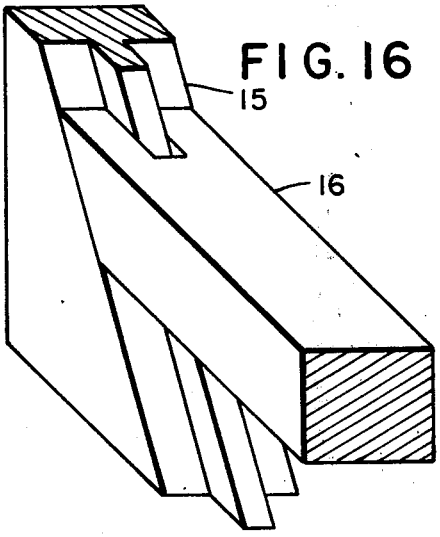
Figure 14:
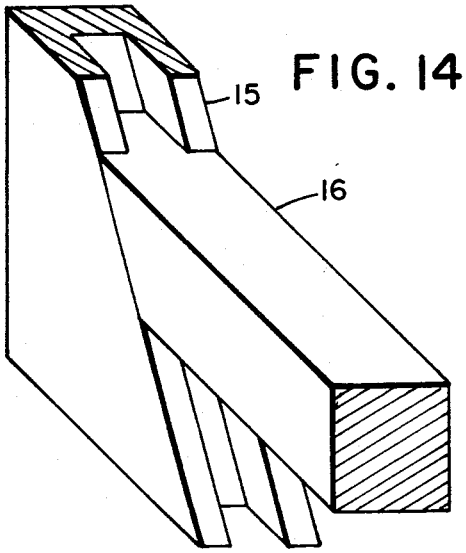
Figure 19:
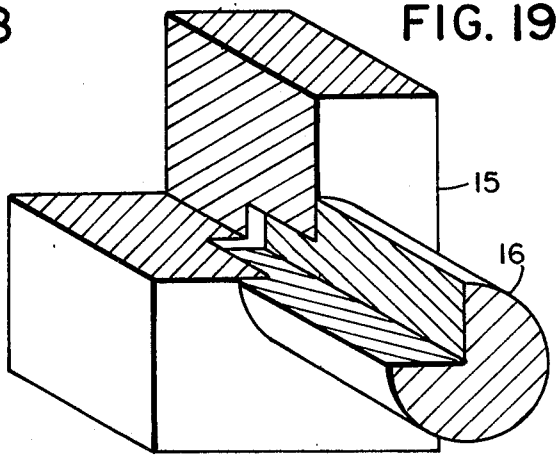
FIGS. 17 to 21 are pictorial views of a junction between a spring loaded or threaded compression member showing two plane members, a recessed side member and a plane compression member, a recessed side member and a protrusioned compression member, a protrusioned side member and a recessed compression member, and, a protrusioned side member and a plane compression member.
Figure 18:
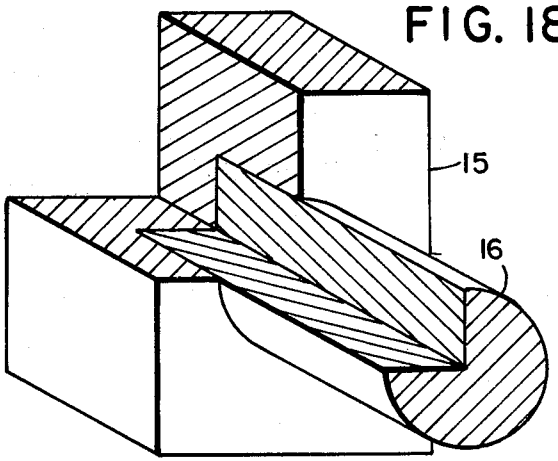
Figure 17:
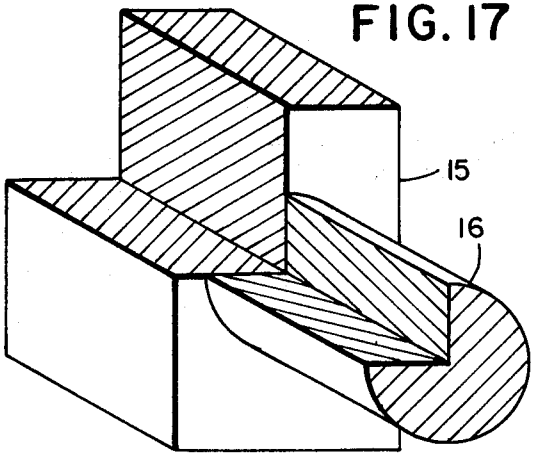
Figure 21:
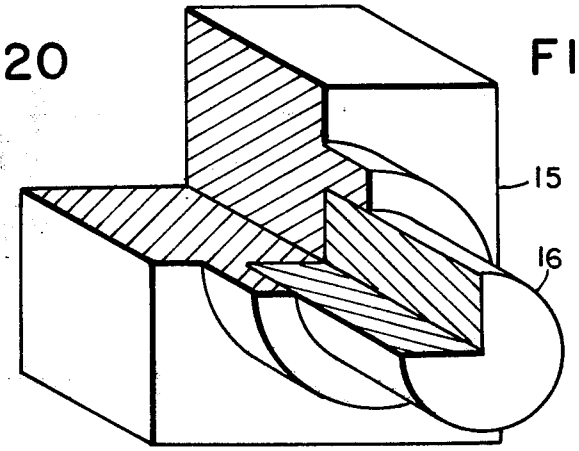
Figure 20:
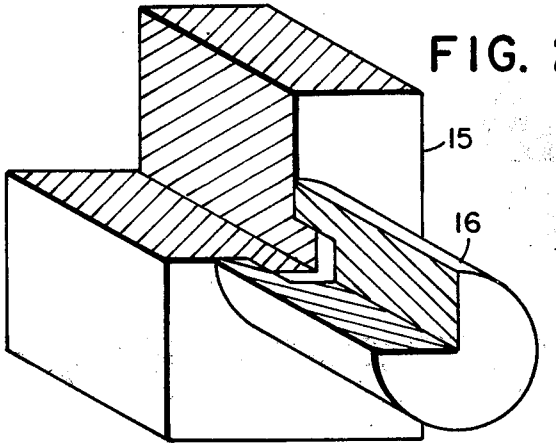

In erected support assemblies, relative motion between the side members and the compression members should not be present. In support assemblies which do not have pieces of spring loaded or threaded compression members permanently attached to the side members, such relative motion is prevented by the friction of the mating surfaces of the junction between the side and compression members. Details of such junctions between a side member 15 and a compression member 16 are shown in FIGS. 12 and 17. In order to supplement friction mating grooved surfaces or mating recessions and protrusions may be incorporated in the junction.

In support assemblies having one-piece compression members, the compression member support surfaces on the side members and/or the surfaces of the compression member which contacts them have at least one tongue and/or groove to prevent lateral motion. FIGS. 13 to 16, illustrate various configurations of such mating junctions between a side member 15 and a compression member 16. The specific geometric shapes of the tongue and groove are arbitrary, however, it is mandatory that they prevent lateral motion.

In support assemblies having spring loaded or threaded compression members, the compression support surfaces on the side members are recessed and/or have recessions or protrusions which mate with corresponding plane contacting surfaces or with protrusions or recessions on the contacting surfaces of the compression member to prevent motion normal to the axis of the compression member. FIGS. 18 to 21 illustrate various configurations of such mating junctions between a side member 15 and a compression member 16. The specific geometric shapes of the recessions and protrusions are arbitrary, however, it is mandatory that they prevent relative motion normal to the axis of the compression members.

A further variation of the support is one in which the compression member is integrally joined to the side members. Such a compression member must be sufficiently flexible to allow installation.

Although various types of compression members and various means of contacting or attaching them to the side members may be used, it is mandatory for any type of compression member that the lines of action of the forces of the compression member on the side members fall in the interior of the figure formed by lines joining the side wall contactors.

The embodiments of the invention in which exclusive property or privilege is claimed are defined as follows:

1. A table support assembly for use in conjunction with an alcove having a pair of side walls and an end wall comprising: a pair of side frame members adaptable to be mounted in spaced relationship in abutment with the respective side walls and at least one compression member disposed perpendicularly between said side frame members and closely adjacent to said end wall and sized to press said side frame members against the respective side walls, each of said side frame members having an upper surface for receiving a table top in flat mounted position resting thereon and also having an elongated cut-out in the rear edge for receiving the table between said side frame members and said end wall in upright stored position substantially parallel to said end wall.

2. A table support assembly as defined in claim 1 wherein each of said side frame members has an enlarged central cut-out.

3. A table support assembly as defined in claim 2 wherein facing surfaces of said side frame members closely adjacent to said end wall slope towards each other in the downward direction and said compression member includes opposite ends which are parallel to and abut the respective facing side frame slopes, whereby said compression member forces said side members apart and into abutment with said side walls respectively as said compression member is forced downwardly.

4. A table support assembly as defined in claim 3 wherein said compression member support surfaces include mating grooved surfaces to prevent lateral motion between said compression member surfaces and said side frame member surfaces.

5. A table support assembly as defined in Claim 1 wherein said side frame members are respectively provided with wall contactors for contacting said alcove sidewalls outside of the lines of action of the forces of the compression member on the side members and base contactors at the bottom edges of said side frame members.

6. A support as defined in claim 1 including a plurality of said compression members and in which facing surfaces of said side frame members closely adjacent to said end wall are vertical and each of said compression members includes at least one threaded screw type device for adjustment of length and compressive force.

7. A compression member as defined in claim 6 in which at least one piece of each of said compression members is permanently attached to a side member.

8. A support as defined in claim 6 in which the compression member support surfaces on said side frames and the contacting surfaces of the compression members include recessions and mating protrusions to prevent motion normal to the axis of the compression member.

9. A support as defined in claim 1 including a plurality of said compression members in which facing surfaces of said side frame members closely adjacent to said end wall are vertical and each of the compression members includes a spring loaded device for adjustment of length and compressive force.

10. A compression member as defined in claim 9 in which at least one piece of each of said compression members is permanently attached to a side member.

11. A support as defined in claim 9 in which the compression member support surfaces on said side frames and the contacting surfaces of the compression members include recessions and mating protrusions to prevent motion normal to the axis of the compression member.

12. A support as defined in claim 1, in which said compression member is integrally joined to said side frame members.

* * * * *